US008206167B2

(12) United States Patent
Reuter et al.

(10) Patent No.: US 8,206,167 B2
(45) Date of Patent: Jun. 26, 2012

(54) ADAPTER SET FOR FLUORESCENT LAMPS CONVERTING TO LUMINESCENT TUBES HAVING SMALLER DIAMETERS EQUIPPED WITH ELECTRONIC BALLAST

(75) Inventors: Carsten Reuter, Taunusstein (DE); Matthias Weise, Eichenberg (AT); Peter Schäfer, Kirchheim/Teck (DE)

(73) Assignee: e-Ressource Österreich GmbH, Eichenberg (AT)

( * ) Notice: Subject to any disclaimer, the term of this patent is extended or adjusted under 35 U.S.C. 154(b) by 0 days.

(21) Appl. No.: 12/992,009

(22) PCT Filed: May 15, 2008

(86) PCT No.: PCT/EP2008/003893

§ 371 (c)(1),
(2), (4) Date: Jan. 12, 2011

(87) PCT Pub. No.: WO2009/138108

PCT Pub. Date: Nov. 19, 2009

(65) Prior Publication Data

US 2011/0117763 A1 May 19, 2011

(51) Int. Cl.
*H01R 33/08* (2006.01)
*F21S 4/00* (2006.01)

(52) U.S. Cl. ..... 439/236; 362/217.12; 362/652

(58) Field of Classification Search ..... 439/236; 362/649, 651, 652, 217.01, 217.12, 217.16
See application file for complete search history.

(56) References Cited

U.S. PATENT DOCUMENTS

| | | | | |
|---|---|---|---|---|
| 2,483,165 | A * | 9/1949 | Young | 439/238 |
| 5,904,415 | A * | 5/1999 | Robertson et al. | 362/260 |
| 6,113,408 | A | 9/2000 | Burwell et al. | |
| 6,376,991 | B1 | 4/2002 | Sundaram et al. | |
| 6,582,102 | B2 * | 6/2003 | Lin | 362/304 |
| 6,624,554 | B2 * | 9/2003 | Holzer | 313/318.01 |
| 6,641,419 | B1 * | 11/2003 | Richardson | 439/230 |
| 6,932,493 | B2 * | 8/2005 | Giannopoulos et al. | 362/260 |
| 6,988,906 | B1 * | 1/2006 | Chen | 439/226 |

(Continued)

FOREIGN PATENT DOCUMENTS

DE 195 12 307 10/1996

(Continued)

OTHER PUBLICATIONS

Written Opinion of the International Searching Authority in corresponding PCT/EP2008/003893 and English language translation of the same.

*Primary Examiner* — Briggitte R Hammond
(74) *Attorney, Agent, or Firm* — Faegre Baker Daniels LLP

(57) ABSTRACT

An adapter set for fluorescent lamps with electronic ballast for converting to a fluorescent tube having a smaller diameter. The electronic ballast and the end cap adapter each on one axial front thereof comprise contact pins having dimensions of fluorescent tubes of larger diameters, and on the opposite axial front have contact sockets for receiving two contact pins of the fluorescent tube having a smaller diameter. Preferably, the electronic components of the ballast are located on at least two spatially separated partial circuit boards which may be connected to each other by a flexible contact strip. A jacket tube has at least one cable channel that extends axially relative thereto to house the wiring connecting the contact pins of the end cap adapter and the electric ballast.

18 Claims, 2 Drawing Sheets

U.S. PATENT DOCUMENTS

Figure 1:
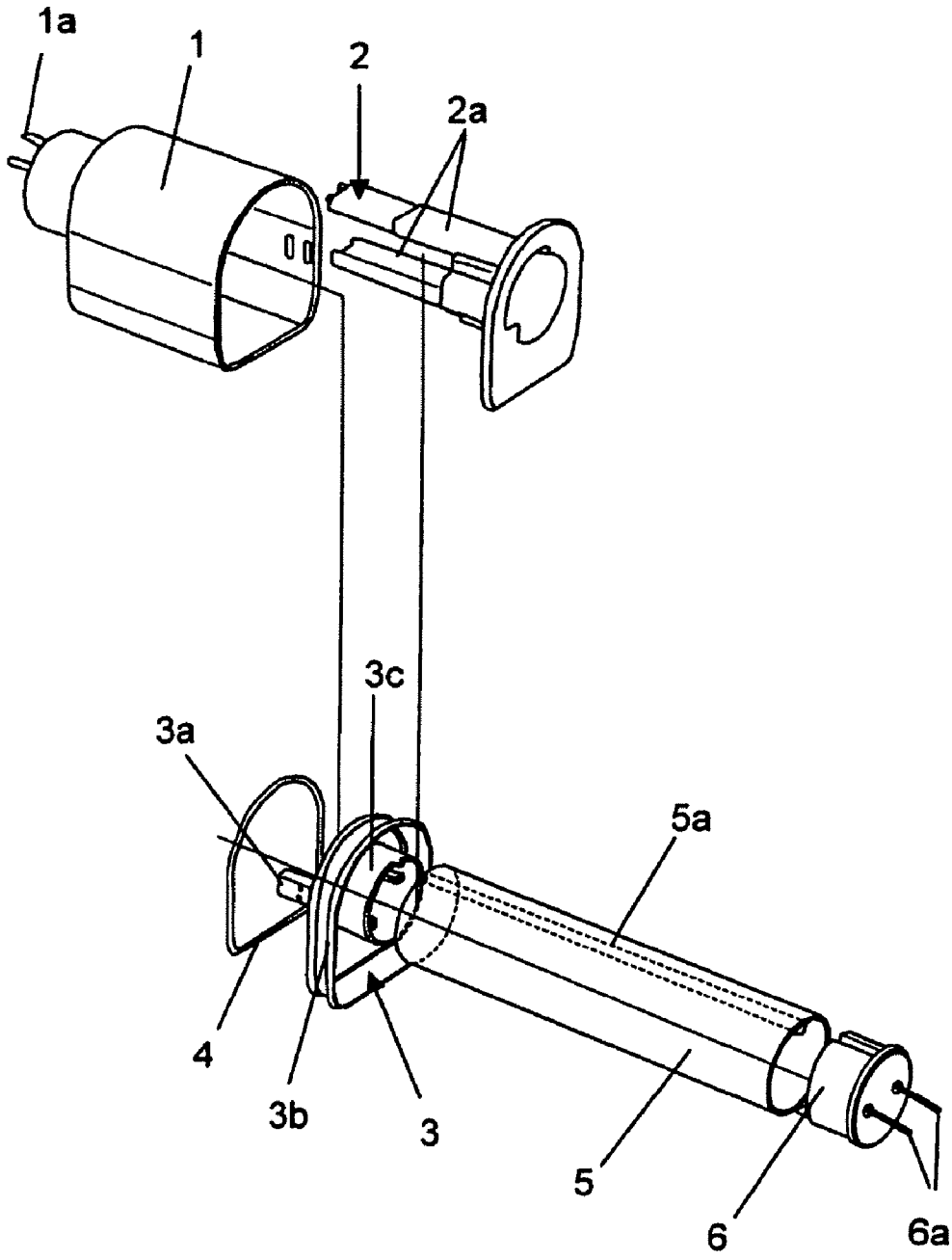

| | | | | |
|---|---|---|---|---|
| 7,052,171 | B1 * | 5/2006 | Lefebvre et al. | 362/649 |
| 7,291,029 | B2 * | 11/2007 | Hale et al. | 439/236 |
| 7,484,980 | B2 * | 2/2009 | Liao | 439/236 |
| 7,549,767 | B2 * | 6/2009 | Lavergne | 362/217.16 |
| 2002/0093279 | A1 | 7/2002 | Chen | |
| 2002/0111070 | A1 | 8/2002 | Nerone et al. | |
| 2003/0095537 | A1 | 5/2003 | Murakami et al. | |
| 2005/0180327 | A1 | 8/2005 | Banerjee et al. | |
| 2006/0067222 | A1 | 3/2006 | Endoh | |
| 2009/0196029 | A1 * | 8/2009 | Kurtz et al. | 362/221 |

FOREIGN PATENT DOCUMENTS

| | | |
|---|---|---|
| DE | 202 18 557 | 4/2004 |
| DE | 20 2006 000 281 | 4/2006 |

* cited by examiner

ADAPTER SET FOR FLUORESCENT LAMPS CONVERTING TO LUMINESCENT TUBES HAVING SMALLER DIAMETERS EQUIPPED WITH ELECTRONIC BALLAST

The invention relates to an adapter set for fluorescent lamps for converting to fluorescent tubes having smaller diameters equipped with electronic ballast.

In particular the invention relates to light systems for T8-/T12 fluorescent lamps for converting to modern and energy-saving T5 fluorescent tubes equipped with electronic ballast.

The fluorescent tubes are straight fluorescent tubes mounted in sockets on both sides which can be inserted (first plugged in and then turned in) in two assigned sockets on the fluorescent lamp carrier (wall or ceiling support)

T8 fluorescent tubes are fluorescent tubes with circa 26 mm diameter and a performance-dependent length of circa 590 mm, 1200 mm and 1500 mm, T12 fluorescent tubes are fluorescent tubes with circa 38 mm diameter and a performance-dependent length of circa 590 mm 1200 mm and 1500 mm, T5 fluorescent tubes are fluorescent tubes with circa 16 mm diameter and a performance-dependent length of circa 288 mm, 549 mm, 849 mm, 1149 mm and 1449 mm. Between the T8 and the T5 fluorescent tubes there is thus a difference in length of circa 50 mm, which corresponds to the difference in length of the distance between the sockets of the fluorescent tube holder. In contrast to T8-/T12 fluorescent tubes, which as a rule are operated with a conventional magnetic ballast, T5 fluorescent tubes can only be operated with an electronic ballast.

The previous adapter sets for fluorescent tubes, e.g. pursuant to patent specification DE 199 00 889 B4 are characterized in that the difference in distance of the shorter T5 fluorescent tubes to the T8 fluorescent tube socket is bridged by adapters plugged in on both sides on the T5 fluorescent tube, wherein one or also both adapter sets contain the electronic ballast.

A standard operation (e.g. observation of electromagnetic compatibility) of the adapter set in the existing lamp socket is however only possible if further electronic parts (e.g. a PFC filter) are mounted in the existing wiring behind the lamp socket cover. In addition due to the wattage restriction on the part of the electronic ballast the 35 watt T5 fluorescent tube is not operated at its nominal capacity, but rather at underload and with this shortening the service life of the T5 tubes considerably in comparison with standard operation.

The object of the present invention is therefore to make possible a simple, safe and cost-effective conversion of the T8-/T12 fluorescent tube sockets for operation with T5 fluorescent tubes by means of a standard lighting system for fluorescent tubes equipped with electronic ballast according to the state of the art by means of a complete encapsulation of electronics and illuminants for use both under dry as well as wet area conditions for the operation of T5 fluorescent tubes at their nominal capacity in the case of a simple exchange of the electronic ballast at the end of its service life.

The difference in length between the sockets of the fluorescent tube holders of fluorescent tubes having greater diameters, e.g. T8, to fluorescent tubes having smaller diameters, e.g. T5, is bridged by a single electronic ballast as adapter on the one axial face of the fluorescent tube and by an end cap adapter on the other axial face of the fluorescent tube, wherein the electronic ballast exhibits all the electronic components of a conventional electronic ballast.

The electronic ballast and the end cap adapter each exhibit contact pins on their one axial face with dimensions of fluorescent tubes having greater diameters, e.g. T8 for receiving in two fluorescent lamp holders and on their other opposing axial face exhibit contact holders for receiving two contact pins of the fluorescent tubes having smaller diameter, e.g. T5.

The advantage in this connection is that as a result the already present installation space between the sockets of the fluorescent tube holders of the longer fluorescent tube having greater diameter to the shorter fluorescent tube having smaller diameter through the electronic ballast and the end cap adapter is bridged and with this a conversion to a fluorescent tube smaller in diameter and shorter in length, e.g. from T8 to T5 is possible in a simple, fast, safe and cost-effective manner.

Advantageous improvements are the subject matter of the dependent patent claims.

In one embodiment of the present invention provision is made that the electronic components of the electronic ballast are located on at least two spatially separated partial circuit boards which are however electrically connected to one another by flexible contact strips.

The advantage in this connection is the fact that the electronic ballast is with this very compactly built and additional electronic components are not necessary in other places and with this the electronic connections can be kept short as well as the assembly expenditure connected therewith, which leads to a price reduction of the adapter set.

Preferably the electronic components of the electronic ballast are provided on 2, 3, or 4 spatially separated rigid partial circuit boards or on one single flexible circuit board which can be offset to partial circuit boards, wherein these partial circuit boards are each positioned in the region of variable longitudinal side walls of the interior of the electronic ballast housing which is essentially cube-shaped, parallelepiped or in general prism-shaped. Naturally provision can be made that at least one or even each of these partial circuit boards in turn is divided into further sub-partial circuit boards which are spatially separated from one another but are electrically connected to one another by flexible contact strips.

The electronic ballast housing is preferably constructed cylindrical on the side facing the fluorescent lamp holder, however is cube-shaped or parallelepiped on the side averted from the fluorescent lamp holder, thus in cross-section square or rectangular and exhibiting two corners. With this a problem-free insertion and turning of the contact pins of the electronic ballast and of the end cap adapter is possible in the assigned sockets of the fluorescent lamp holder.

The partial circuit boards, as well as their sub-partial circuit boards are preferably placed on a printed circuit board holder, which can be inserted together with the circuit boards into the electronic ballast and can be fixed there. This printed circuit board holder has at least two mounting fingers which extend in longitudinal direction of the fluorescent tubes and whose free fingertips receive the partial circuit board for the T8 contact pins and hence serve the purpose of insertion into the correct position of a further partial circuit board for the sockets of the fluorescent tubes having greater diameter.

The electronic ballast housing is constructed closed on an axial face and only the contact pins for reception in the sockets of the fluorescent tube holders protrude through the electronic ballast housing from the interior. On the other axial face of the electronic ballast housing, which lies opposite the fluorescent tubes, the electronic ballast housing is provided with an opening into which the printed circuit board holder together with all the circuit boards can be axially inserted so that the printed circuit board holder is located in the electronic ballast housing. A separate flange housing is provided as a cover sealing the opening of the electronic ballast housing, said flange housing being mounted in or on this opening and then elastically resilient snap-in lugs catch on the flange housing and/or on the electronic ballast housing in associated indentations and hence forms a firm connection, said connection in particular being detachable by one hand between the flange housing and the electronic ballast housing. Between the flange housing and the electronic ballast housing a sealing ring is installed.

On the side of the flange housing facing the electronic ballast housing said flange housing is equipped with integrated electric plug contacts which make it possible that the electric wires of the contact pins of the end cap adapter are electrically connected to the electronic ballast housing. As a result the entire electronic ballast housing can as and when required be replaced without problems.

On the side of the flange housing facing the fluorescent tube said flange housing is equipped with a tube socket which makes it possible that on or in said tube socket a transparent or translucent jacket tube is received which encloses the fluorescent tube having smaller diameter or shorter in a protective and sealing manner and whose radiated light is emitted to the surroundings scattering diffusely. In addition this jacket tube for one thing serves the purpose of seeing to it that the impression arises that the longer fluorescent tube (e.g. T8) or the fluorescent tube having greater diameter is present, and not the shorter fluorescent tube or the fluorescent tube having smaller diameter (e.g. T5), as a result of which in the case of a plurality of fluorescent lamps a mix between T8 fluorescent tubes that are already present and T5 fluorescent tubes now being replaced can be present without one being able to detect this from the outside. In addition this jacket tube serves as a lug for the wiring between the electronic ballast and the contact pins of the end cap adapter.

It is preferred that in axial extension of the jacket tube within and/or outside of the sheath during the manufacturing process of the jacket tube at least one cable channel is produced. Naturally this at least one axial cable channel can also be subsequently attached to said jacket tube after its production or the cable can also only be inserted into the jacket tube. Advantageously said at least one axial cable channel is arranged on the jacket tube in such a way that said cable channel and with it the wiring held within is located on the inside, which is facing the fluorescent tube holder, i.e. on the side averted from the light beam direction direction.

The jacket tube is in particular formed of transparent or translucent in particular extruded plastic, but can also consist of transparent or translucent glass, or a combination of these materials.

The inside diameter of the jacket tube corresponds advantageously to about the outside diameter fluorescent tube socket, at which the contact pins are located.

The wall thickness of the jacket tube is approximately 1 mm, wherein for reception of a T5 fluorescent tube with a diameter of circa 16 mm, the jacket tube has an inside diameter of circa 23.6 mm and an outside diameter of circa 25.4 mm, thus about the outside diameter of circa 26 mm of a T8 fluorescent tube.

The complete design of housing and jacket tube is preferably splashproof, so that operation under wet area conditions is also possible.

In the following the invention will be explained more closely by means of drawings showing only one embodiment. In this connection further features useful to the invention and advantages of the invention arise from the drawings and their description.

Figure 2:
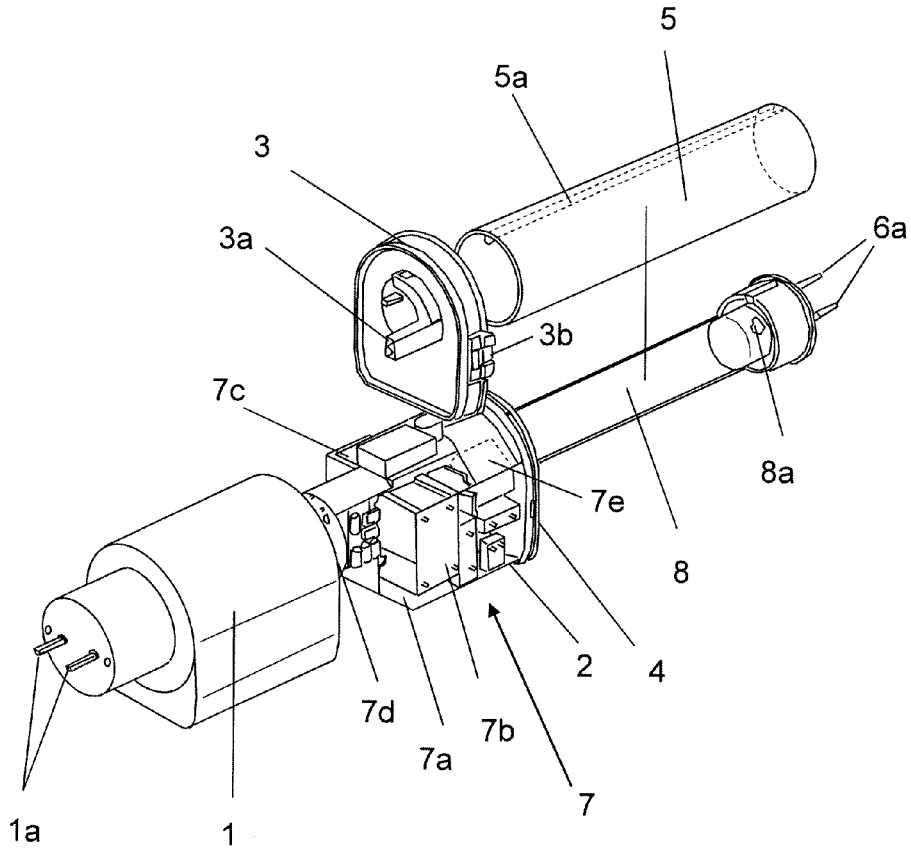

The figures show the following:

FIG. 1: shows an exploded view of the inventive adapter set without electronic ballast electronics and electric cable;

FIG. 2: shows a partially assembled exploded view of the adapter set according to FIG. 1, however with the electronic ballast electronics and with a T5 fluorescent tube between the electronic ballast and the end cap adapter.

The inventive adapter set according to the figures contains an electronic ballast housing 1 with contact pins, which are designed for sockets for T8 fluorescent tubes and are soldered onto a partial circuit board 7*d*.

The printed circuit board holder 2 holds the electronic ballast electronics 7 with printed circuit boards (circuit boards) 7*a*, 7*b*, 7*c*, 7*d* and flex bands 7*e*, wherein the flex bands 7*e* produce the electric contact between the individual printed circuit boards (circuit boards) 7*a*, 7*b*, 7*c*, 7*d*. The printed circuit board holder 2 together with the electronic ballast electronics 7 is then inserted into the interior of the electronic ballast housing 1 and catches there. The front free tips of the mounting finger 2*a* are there in order to insert the partial circuit board 7*d*, upon which the 2 contact pins 1*a* for the T8 sockets are located, into the correct position and without problems into the interior of the electronic ballast housing 1 and there to be fixed and to insert the contact pins 1*a* through the openings in the face of the electronic ballast housing 1.

As a cover of the electronic ballast housing 1 a flange housing 3 is placed axially on the printed circuit board holder 2 and locked by means of its snap-in lugs 3*b* with associated slots in the electronic ballast housing 1, wherein between the flange housing 3 and the electronic ballast housing 1 a sealing ring 4 is inserted. The flange housing 3 has in addition plug contacts 3*a* which make possible electric contact of the contact pins 6*a* of the opposing end cap adapter 6 via (not shown in the figure) electric wires in the cable channel 5*a* of the transparent or translucent jacket tube 5 to the electronic ballast electronics through a simple plug connection.

One end of the jacket tube 5 is placed on the tube socket 3*c* of the flange housing 3 then and there in particular adheres to it. The end cap adapter 6 is placed on the other end of the jacket tube 5 and likewise in particular adhering to it, wherein also the end cap adapter 6 exhibits a partial circuit board which bears two contact pins 6*a* for T8 sockets, said contact pins protruding from the free face of the end cap adapter 6 and being able to be plugged in and turned in the socket of the fluorescent lamp.

Within the jacket tube 5 now the T5 fluorescent tube is held with end-side sockets on both sides 8*a* and two T5 contact pins each, wherein the T5 contact pins can be plugged into associated T5 sockets on the circuit boards 7*d* of the electronic ballast and of the flange housing 3.

The T5 fluorescent tube can be easily replaced through the openings in the flange housing 3.

In particular all non-electric and non-electronic components of the inventive adapter set are constructed in plastic.

Drawing Legend

1 Electronic ballast housing with contact pins 1*a* for T8 fluorescent tubes or for reception in their sockets
2. Printed circuit board holder with mounting fingers 2*a*
3. Flange housing with Plug contacts 3*a* and Snap-in lugs 3*b*, as well as tube sockets 3*c*
4. Sealing ring
5. Jacket tube with axial interior cable channel 5*a*
6. End cap adapter with contact pins 6*a* for T8 fluorescent tubes or for reception in their sockets
7. Electronic ballast electronics with printed circuit boards (circuit boards) 7*a*, 7*b*, 7*c*, 7*d* and flex bands 7*e*
8. T5 fluorescent tube with end-side sockets 8*a*

The invention claimed is:

1. An adapter set for fluorescent lamps with two fluorescent lamp sockets for conversion to a fluorescent tube having smaller diameter, comprising: an electronic ballast held in an electronic ballast housing, two adapters which are formed respectively by the electronic ballast and by an end cap adapter, wherein the electronic ballast and the end cap adapter each include contact pins on one axial face thereof with dimensions of fluorescent tubes having greater diameters for receiving in two fluorescent lamp holders and on the other opposing axial face thereof include contact holders for receiving two contact pins of the fluorescent tube having smaller diameter, and wherein the electronic ballast housing on the axial face opposite the contact pins thereof or on the axial face facing the fluorescent tube having smaller diameter has an opening which is sealed by a flange housing, wherein the flange housing is detachably connected to the electronic ballast housing and is equipped with electric plug contacts which make an electric connection to the contact pins of the end cap adapter and the electronic ballast housing by means of electric wiring, wherein the flange housing on an axial front thereof facing the electronic ballast housing has an opening through which the fluorescent tube having smaller diameter can be changed, and the flange housing receives a transparent or translucent jacket tube which encloses the fluorescent tube having smaller diameter in a protective manner, wherein the outside diameter of the jacket tube corresponds to about the outside diameter of the fluorescent tube having greater diameter, and at least one cable channel extends axially relative to the jacket tube within or outside of the jacket tube, the cable channel serving as a lug for the wiring of the electric connection between the contact pins of the end cap adapter and the electronic ballast.

2. The adapter set according to claim 1, wherein the electronic ballast housing on a side facing the lamp holder has a length of at least 15 mm and a maximum outside diameter of circa 26 mm in order to be able to receive existing wet area linings.

3. The adapter set according to claim 1, wherein the electronic ballast housing is constructed cylindrical on the side facing a fluorescent lamp wall or ceiling support, however is cube-shaped or parallelepiped on the side averted from the fluorescent lamp wall or ceiling support.

4. The adapter set according to claim 1, wherein the flange housing is equipped with a tube socket which receives a transparent or translucent jacket tube which encloses the fluorescent tube having smaller diameter in a protective and sealing manner.

5. The adapter set according to claim 1, wherein the cable channel is produced together with the jacket tube in one production step or is mounted to the jacket tube subsequently after the production of said jacket tube.

6. The adapter set according to claim 1, wherein the jacket tube is formed of transparent or translucent plastic, and/or of transparent or translucent glass.

7. The adapter set according to claim 1, wherein the inside diameter of the jacket tube corresponds to about the outside diameter of the end cap adapter at which the contact pins are located.

8. The adapter set according to claim 1, wherein the flange housing has an opening on its axial face facing the electronic ballast through which the fluorescent tube having smaller diameter can be electrically connected to a contact socket of the electronic ballast.

9. The adapter set according to claim 1, wherein the electronic components of the electronic ballast are located on at least two electrically connected rigid or flexible partial circuit boards.

10. The adapter set according to claim 9, wherein the partial circuit boards form one single circuit board and are electrically and mechanically connected to one another by flexible circuit board regions.

11. The adapter set according to claim 9, wherein the partial circuit boards are each positioned in the region of longitudinal side walls of the interior of the electronic ballast housing which is essentially cube-shaped, parallelepiped or in general prism-shaped.

12. The adapter set according to claim 9, wherein at least one of the partial circuit boards in turn is divided into at least two further sub-partial circuit boards which are spatially separated from one another and are electrically connected to one another.

13. The adapter set according to claim 9, wherein the partial circuit boards are spatially separated from one another and are electrically connected to one another by flexible contact strips.

14. The adapter set according to claim 13, wherein the partial circuit boards are each positioned in the region of longitudinal side walls of the interior of the electronic ballast housing which is essentially cube-shaped, parallelepiped or in general prism-shaped.

15. The adapter set according to claim 9, wherein the partial circuit boards are disposed on a printed circuit board holder that is located together with the circuit boards in the electronic ballast housing and which is fixed on said electronic ballast housing.

16. The adapter set according to claim 15, wherein the printed circuit board holder has at least two axially extending mounting fingers whose free fingertips receive the partial circuit board for the contact pins of the electronic ballast with the dimensions of a fluorescent tube having greater diameter.

17. The adapter set according to claim 1, wherein the electronic ballast housing is constructed closed on one axial face and only the contact pins thereof protrude through the electronic ballast housing and on the other axial face of the electronic ballast housing its opening is sealed by the flange housing with the interposition of a sealing ring.

18. The adapter set according to claim 17, wherein the flange housing includes elastically resilient snap-in lugs which can be operated with one hand and which are detachably caught on the electronic ballast housing in associated indentations.

* * * * *

UNITED STATES PATENT AND TRADEMARK OFFICE

CERTIFICATE OF CORRECTION

PATENT NO. : 8,206,167 B2
APPLICATION NO. : 12/992009
DATED : June 26, 2012
INVENTOR(S) : Carsten Reuter et al.

It is certified that error appears in the above-identified patent and that said Letters Patent is hereby corrected as shown below:

Title Page, item (54) and Col. 1, line 2; Amend the Title as follows: after LAMPS insert --FOR--

Signed and Sealed this
Fourth Day of September, 2012

David J. Kappos

David J. Kappos
*Director of the United States Patent and Trademark Office*